US005618237A

United States Patent [19]

Shinjo

[11] Patent Number: 5,618,237

[45] Date of Patent: Apr. 8, 1997

[54] APPARATUS FOR MAKING SELF-PIERCING NUTS

[75] Inventor: Hiroshi Shinjo, Osaka, Japan

[73] Assignee: Yugenkaisha Shinjo Seisakusho, Osaka, Japan

[21] Appl. No.: 352,615

[22] Filed: Dec. 9, 1994

[30] Foreign Application Priority Data

Dec. 17, 1993 [JP] Japan ..... 5-343958

[51] Int. Cl.[6] ..... B21D 37/08

[52] U.S. Cl. ..... 470/91

[58] Field of Search ..... 29/716, 798; 72/464, 72/474; 470/89, 91, 18, 25

[56] References Cited

U.S. PATENT DOCUMENTS

| | | | |
|---|---|---|---|
| 1,674,310 | 6/1928 | Topping | 470/90 |
| 2,253,765 | 8/1941 | Cox | 470/91 |
| 2,540,852 | 2/1951 | Wilcox | 470/91 |
| 4,633,560 | 1/1987 | Muller | 72/464 |

FOREIGN PATENT DOCUMENTS

| | | |
|---|---|---|
| 2111524 | 3/1971 | Germany . |
| 2700546 | 1/1977 | Germany . |
| 43-14770 | 6/1962 | Japan . |
| 51-41868 | 11/1976 | Japan . |
| 5-50174 | 3/1993 | Japan . |

*Primary Examiner*—Lowell A. Larson
*Assistant Examiner*—Thomas C. Schoeffler
*Attorney, Agent, or Firm*—Antonelli, Terry, Stout & Kraus, LLP

[57] ABSTRACT

An apparatus makes self-piercing nuts from blanks (11) each having a cylindrical pilot portion (13) which has a raw unopened and unthreaded bore (12) and an end surface serving as a punch. The pilot portion surrounded by a rim (14) extending along a periphery a nut body, and an annular groove (15) is present between the pilot (13) and the rim. The apparatus has a punching die which has a boring punch (33) and a first cylindrical insert (35) fitted on the punch serving to open the bore (12). The boring punch has at its basal portion a tapered annular wall (34), and the cylindrical insert (35) having at its end surface an annular lug (36) capable of fitting in the annular groove. The tapered wall (34) radially expands an end of the pilot portion, so that its peripheral wall is forcibly slanted in a radial direction and an annular edge (13*a*) of the peripheral wall is stopped by an inner periphery of the annular lug (36). Due to this feature, the apparatus can mass-produce the self-piercing nut of an accurate dimension which can smoothly punch an opening trough a metal plate, and an invariable and sufficient clinching force is ensured to the self-piercing nut.

4 Claims, 4 Drawing Sheets

APPARATUS FOR MAKING SELF-PIERCING NUTS

BACKGROUND OF THE INVENTION

1. Field of the Invention

The present invention relates to an apparatus for making self-piercing nuts which each can pierce a metal plate to punch an opening therethrough, wherein a peripheral edge portion thereof is deformed to fit in a groove of the nut thus secured to the metal plate.

2. Description of the Prior Art

A variety of the self-piercing nuts, taking place of the weldable nuts or the clinch nuts, are widely used for example in manufacture of automobile vehicles which have many parts screwed with bolts to metal plates. Any self-piercing nut must withstand a torque so as not to rotate along with the bolt, and must clinch strongly to resist evulsion from the metal plate. Recently, self-piercing nuts of novel and high stress types have been demanded to meet a requirement for a higher fastening force.

Generally, each self-piercing nut has a cylindrical pilot portion having a female thread as well as an end surface serving as a punch. The pilot portion formed centrally of a nut body is surrounded by a rim extending along a periphery of the nut body and protruding therefrom in the same direction as the pilot portion. Therefore, an annular groove is provided between the pilot portion and the rim. In one of the high stress type, the nut body is of a tetragonal or hexagonal shape so that the annular groove has a non-circular configuration to improve the torque resistance. In another high stress type, at least one of the rim and the peripheral wall of pilot portion facing the rim is slanted relative to the axis of the nut body. The annular groove defined by such a slanted member or between the slanted members has a width increasing from its opening towards its bottom, thus being dovetailed in cross section to improve its clinching property.

FIG. 5 illustrates a self-piercing nut 1 of the high stress type secured to a metal plate 10. This self-piercing nut 1 comprises a pilot portion 3 which has a threaded bore 2 formed centrally of a nut body. A rim 4 extending along a periphery of the nut body and protruding therefrom surrounds the pilot portion, and an annular groove 5 is provided between the rim and the pilot portion. Both the side surfaces 6 and 7 of pilot portion 3 and rim 4 are slanted relative to the axis of the nut body, so that the annular groove 5 is dovetailed in cross section. In use of this self-piercing nut, a caulking die 8 cooperates with an end surface of the pilot portion 3 to punch an opening through the metal plate 10. A peripheral edge portion 10*a* of the punched opening will be deformed and forced to fit in the annular groove 5 of the nut 1 thus secured to the metal plate 10.

As seen in FIG. 5, an outer circular edge 3*a* of the pilot portion 3 (is an upper circular edge of one of the peripheral walls 6 which face one another to define the annular groove 5) serve as a cutting blade which cooperates with a caulking die 8 to punch the opening through the metal plate 10. The diameter $D_1$ of the outer circular edge 3*a*, that is an inner diameter of the annular groove 5, must be highly accurate in dimension. The other peripheral wall 7 defining the annular groove has an inner circular edge 7*a*. This edge 7*a* exerts a clinching force to a peripheral edge portion 10*a* of the opening formed through the metal plate 10, after said edge portion 10*a* is deformed and forced by the caulking die 8 into the annular groove 5. The diameter $D_2$ of said inner circular edge 7*a*, that is an outer diameter of the annular groove 5, also must be highly precise in dimension for invariable and reliable clinching force.

SUMMARY OF THE INVENTION

Therefore, an object of the present invention is to provide an apparatus adapted to mass-produce high quality self-piercing nuts, which apparatus forms each self-piercing nut to have protruding peripheral walls facing one another to define an annular groove of a dovetailed cross section. The apparatus must cause either of or both the peripheral walls to be slanted at an accurate angle relative to the nut's axis. The pilot portion which the apparatus forms as one of the peripheral walls of each nut has to be shaped such that an opening can smoothly be punched through a metal plate. An invariable and sufficient clinching force must be ensured for the punched opening.

According to the invention, an apparatus for making self-piercing nuts is adapted to manufacture them from their blanks which each have a cylindrical pilot portion having blind bores coaxial with and separated by a blind bottom from each other and having an end surface which later in use will function as a punch capable of piercing a metal plate. The blank has an annular groove with the pilot portion as one of the peripheral walls thereof formed centrally of a nut body and surrounded by a rim as the other peripheral wall extending along a periphery of the nut body and protruding therefrom in the same direction as the pilot portion, thus providing an annular groove between the pilot portion and the rim. The apparatus comprises a punching die which has a boring punch and a first cylindrical insert fitted thereon, the boring punch serving to remove the bottom so as to cause the blind bores to communicate with each other and having at its basal portion a first tapered annular wall. The first cylindrical insert has at its end surface an annular lug capable of fitting in the annular groove, so that when the tapered annular wall of the boring punch radially expands an end of the pilot portion, a peripheral wall thereof defining the annular groove is forcibly slanted centrifugally and an outer circular edge of said peripheral wall is stopped by an inner periphery of the annular lug protruding from the cylindrical insert.

Also according to the present invention, the apparatus may comprise a further punching die which has a second die having a cavity for receiving a blank for the self-piercing nut, and further has a second cylindrical insert disposed in a bottom region of the cavity. The second die has in its inner region a second tapered annular wall so that the rim is forcibly slanted centripetally. A second annular lug is formed at an end surface of the second cylindrical insert so that an inner circular edge of said rim is stopped by an outer periphery of the second annular lug when the annular groove is caused to become dovetailed in cross section.

In operation of the apparatus, the tapered annular wall of the boring punch will radially expand the pilot portion's end of the blank for the nut. The peripheral wall of said pilot portion will thus be forced into a slanted position relative to the axis of the self-piercing nut until the outer circular edge of said peripheral wall bears against the inner periphery of the first cylindrical insert's annular lug. In the case wherein the apparatus comprises the second cylindrical insert having the second annular lug, its outer periphery will bear against the inner circular edge of the rim, when the second tapered annular wall in the second die's cavity causes the rim to be slanted towards the axis. Thus, the pilot portion and the rim are finished to be of an accurate dimension.

THE PREFERRED EMBODIMENTS

Figure 1:
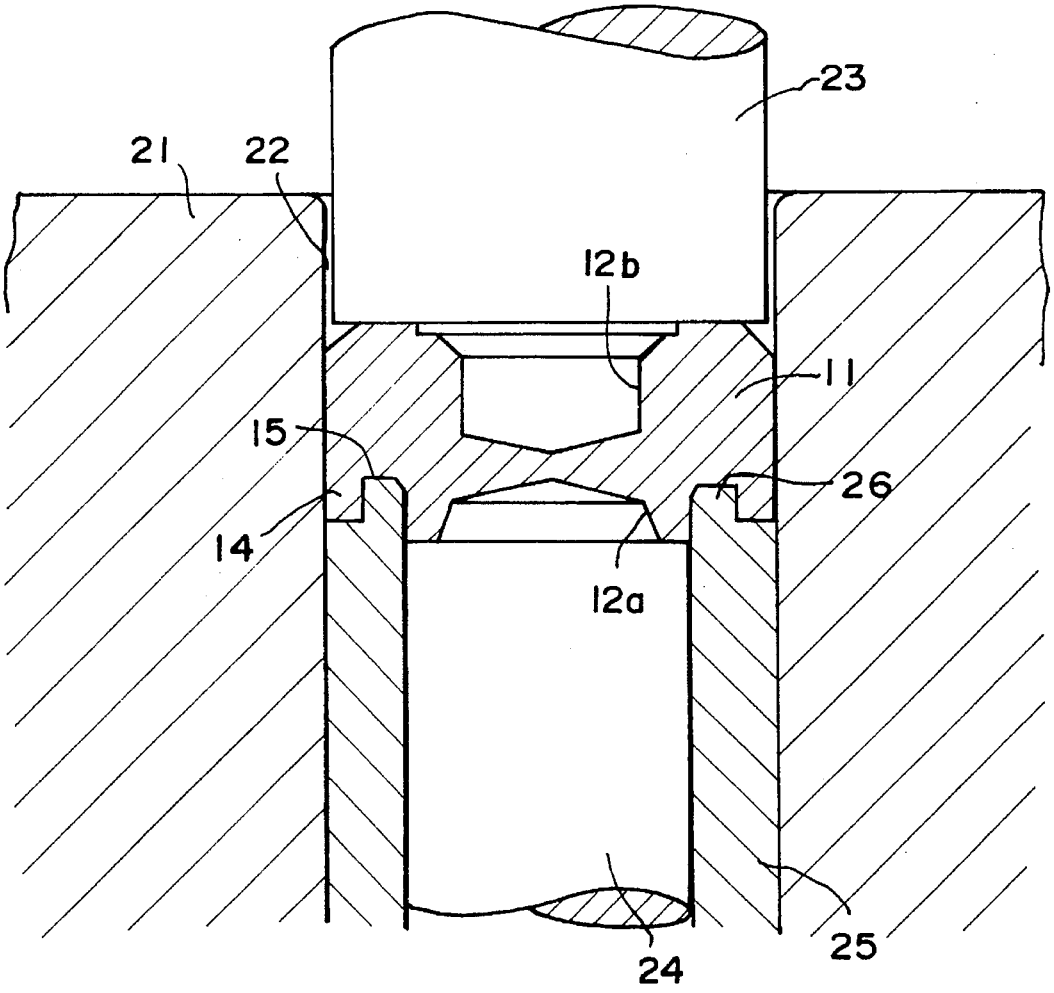
FIG. 1 is a cross section of a blank for a self-piercing nut, which blank is being formed and will be subjected to a subsequent process carried out using an apparatus that is provided herein.

Now, some embodiments of the present invention will be described referring to the drawings.

FIG. 1 shows the preliminary step of forming a blank for a self-piercing nut which will be finished using an apparatus of the present invention. At this step, a raw piece which is not shown but has been undergone some steps will be placed in a cavity 22 of a preliminary die 21. A preliminary punch 23 and a knock-out pin 24 will be driven towards each other to press opposite sides of the raw piece so that blind bores 12*a* and 12*b* are produced. The blind bores which will be threaded later are still separated by a bottom at this step. Simultaneously with the forming of said blind bores, a sleeve punch 25 fitted on the knock-out pin 24 will be pressed to one end surface of the blank. An annular lug 26 protruding from the pressing end of said sleeve punch will thus produce a cylindrical pilot portion 13 centrally of a nut body. This pilot portion surrounding the blind bore 12*a* has an end surface, which later in use will function as a punch capable of piercing a metal plate. As a result of such a pressing by the sleeve punch 25, a rim 14 is formed at the same time as the pilot portion 13. This rim 14 protrudes from and coaxially with the nut body's periphery so as to surround the pilot portion, whereby the blank 11 has an annular groove 15 defined between the pilot portion 13 and the rim 14. An annular end surface of the rim 14 is retracted a distance from that of the pilot portion.

Figure 2:
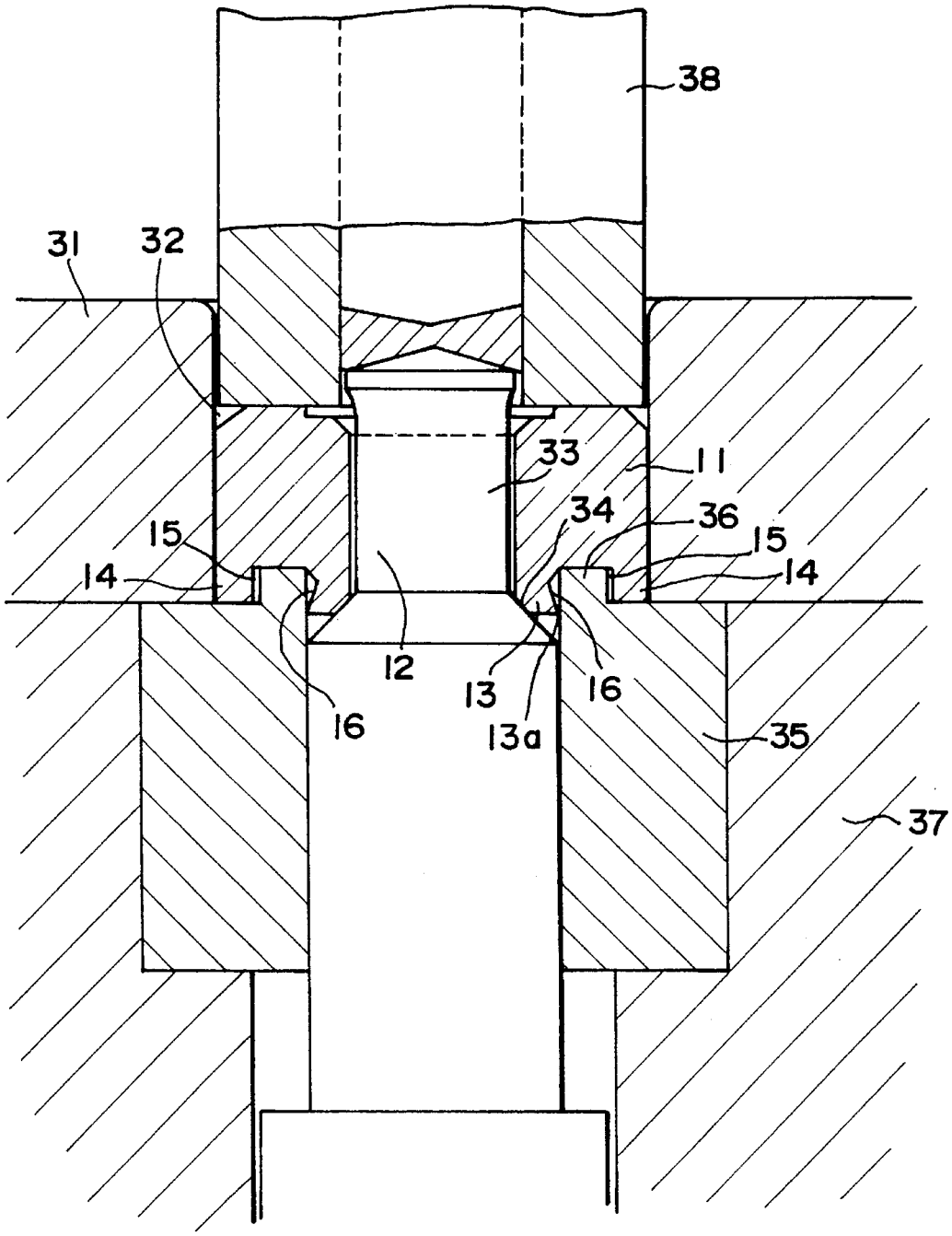
FIG. 2 is a cross section of the blank being pressed in the apparatus provided in one mode of the invention, wherein a pilot portion of the blank is expanded radially.

FIG. 2 shows an apparatus provided by the present invention. This apparatus comprises a punching die used to expand an end of the pilot portion 13 radially and outwardly. A peripheral wall 16 defining the annular groove 15 will thus be slanted relative to the nut's axis so that the annular groove 15 becomes dovetailed. In detail, a first stationary die 31 has a cavity 32 to allow a boring punch 33 to advance centrally of this cavity. The boring punch 33 has at its basal region a tapered annular wall 34. A first cylindrical insert 35 fitted on the boring punch 33 has an end surface from which an annular lug 36 protrudes to surround the tapered annular wall 34. The first cylindrical insert 35 is held stationary in place in a holder 37.

A pressing punch 38 will be driven to press the blank 11 for nut placed in the cavity 32 of the first stationary die 31. The boring punch 33 will thus remove the bottom partitioning the blind bores 12*a* and 12*b* from each other, so as to open through the blank a penetrating but unthreaded rough bore 12, with the annular lug 36 remaining in the annular groove 15. Subsequently, the tapered annular wall 34 will radially expand the end of the pilot portion 13, so that an outer peripheral wall 16 thereof is slanted with respect to the axis, thereby rendering the annular groove 15 dovetailed in cross section. An outer circular edge 13*a* of the pilot portion 13 (viz. an outer circular edge of said peripheral wall 16) will be stopped by an inner periphery of the annular lug 36, when said pilot portion is expanded. Therefore, the pilot portion 13 is protected from an excessive deformation which would undesirably vary its outer diameter (viz. an inner diameter of annular groove 15).

Figure 3:
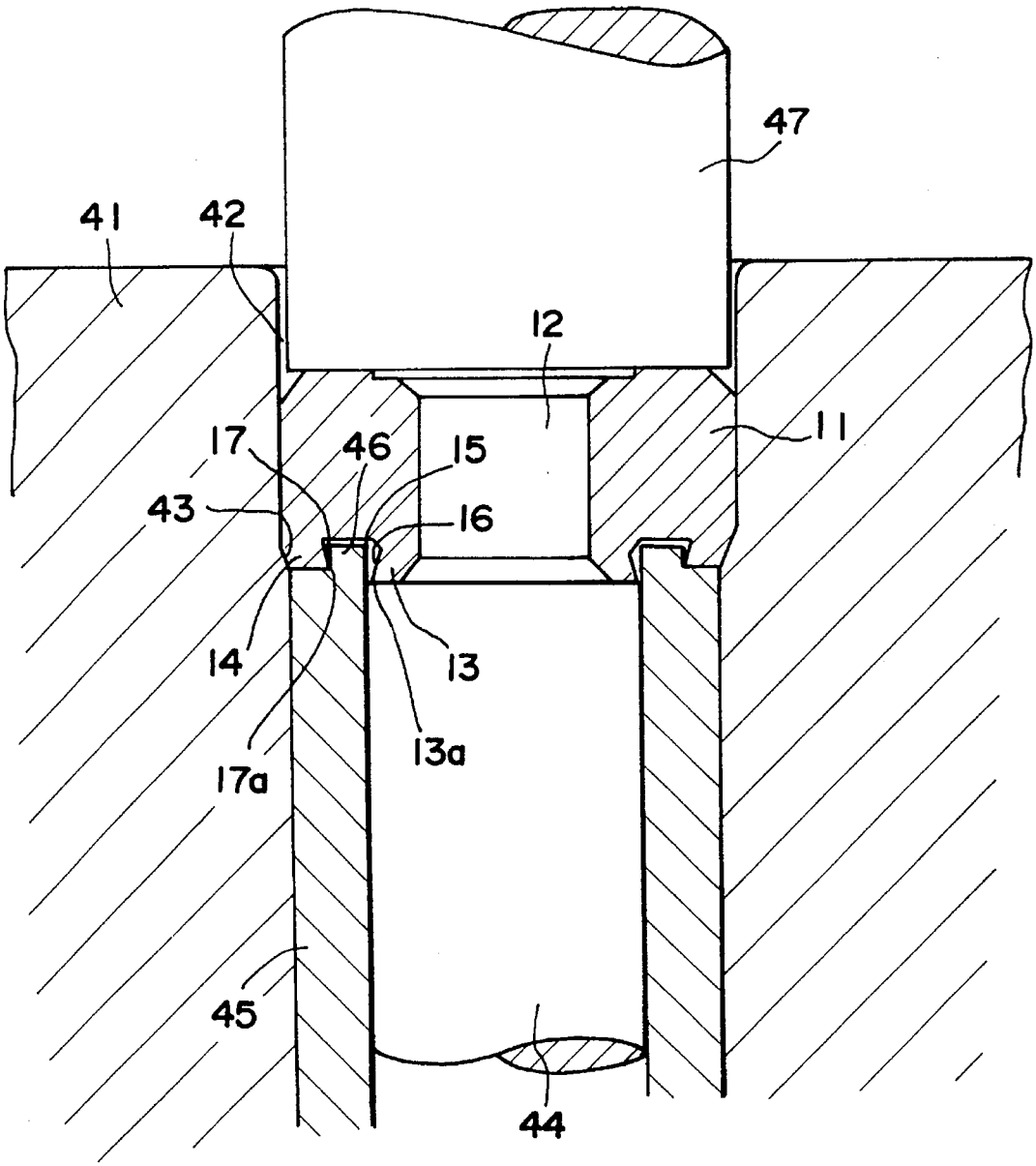
FIG. 3 is also a cross section of the blank having a rim that is being bent in the apparatus provided in another mode of the invention.

FIG. 3 shows the apparatus provided by the present invention, in another mode thereof. This apparatus comprises in this mode a further punching die operable to slant the rim 14 towards the axis of the expanded pilot portion 13. The annular groove 15 will thus be rendered fully dovetailed to have a width increasing towards its bottom. In detail, the further punching die comprises a second stationary die 41 having in its inner region of cavity 42 a second tapered annular wall 43, the latter 43 forcing the rim 14 towards the axis. A second cylindrical insert 45 fitted on a knock-out pin 44 and place in a bottom region of the cavity 42 has a second annular lug 46. This annular lug 46 facing the tapered wall 43 is separated therefrom by a distance, and the cylindrical insert 45 is held stationary in the second stationary die 41.

A second pressing punch 47 is operative to press, towards the insert 45, the blank 11 for the self-piercing nut held in the cavity 42. With the second annular lug 46 fitted in the annular groove 15, the tapered annular wall 43 will force the rim 14 toward the axis, so that the rim's inner peripheral wall 17 is slanted with respect to the axis, thereby rendering the annular groove 15 fully dovetailed in cross section. An inner circular edge 17*a* of the peripheral wall 17 will be stopped by an outer periphery of the annular lug 46, when the rim is deformed. Therefore, the rim 14 is protected from an excessive deformation so as to ensure an accurate outer diameter of annular groove 15.

Figure 4:
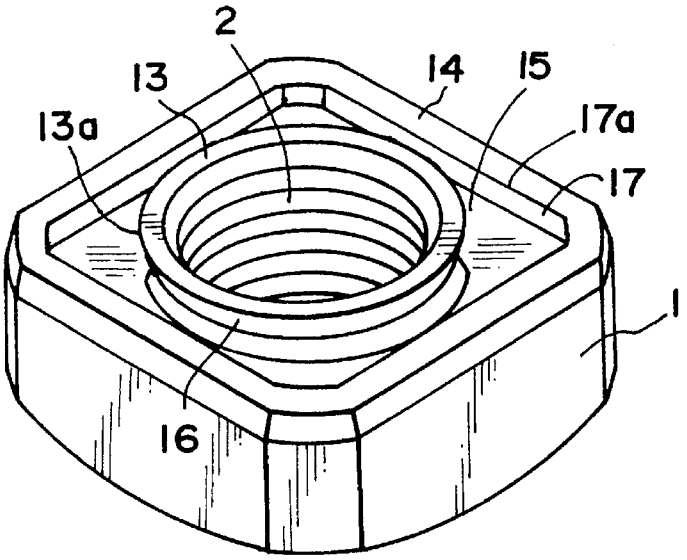
FIG. 4 is a perspective view of the finished self-piercing nut.
Figure 5:
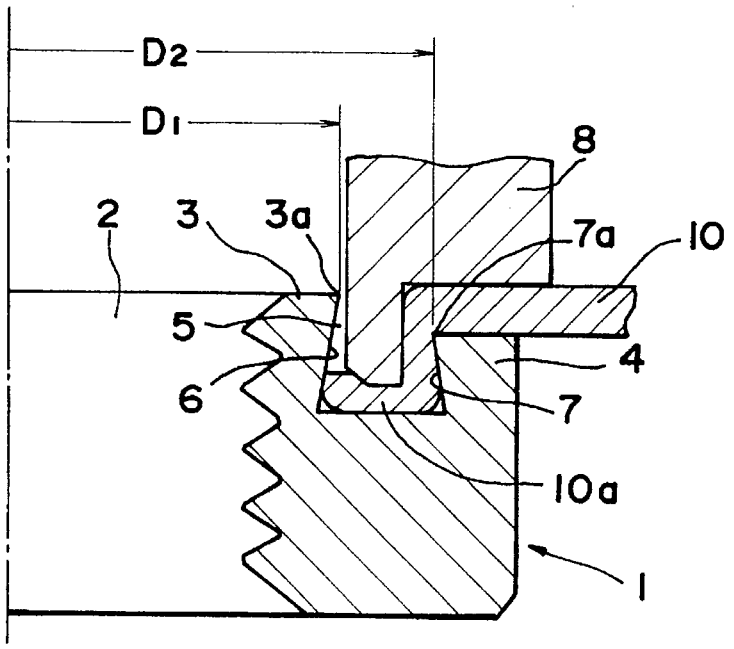
FIG. 5 illustrates the nut which has been pierced and is affixed to a metal plate.

A female thread will finally be tapped in the raw bore 12 of each blank 11 so that the self-piercing nut 1 is finished as shown in FIG. 4.

Both the peripheral walls 16 and 17 are slanted to provide a fully dovetailed annular groove 15 in the described embodiment. However, only one of them 16 and 17 may be slanted to produce a semi-dovetailed annular groove 15 also having its width increasing towards its bottom.

In summary, the apparatus provided herein comprises at least one annular lug which stops the pilot portion's outer circular edge and/or the rim's inner circular edge when the pilot portion and/or the rim are deformed to become slanted with respect to the nut's axis. The pilot portion and the annular groove which are thus finished precisely are effective to permit the self-piercing nut to smoothly punch an opening trough a metal plate, and an invariable and sufficient clinching force is ensured to the self-piercing nut.

What is claimed is:

1. An apparatus for making self-piercing nuts from blanks therefor which each have a cylindrical pilot portion having blind bores coaxial with and separated by a blind bottom from each other and having an end surface serving as a punch, with the pilot portion as one of peripheral walls formed centrally of a nut body being thereby surrounded by a rim as another peripheral wall extending along a periphery of the nut body and protruding therefrom in the same direction as the pilot portion so as to provide an annular groove between the pilot portion and the rim, the apparatus comprising:

a punching die which has a boring punch and a first cylindrical insert fitted thereon;

the boring punch serving to remove the bottom so as to cause the blind bores to communicate with each other;

the boring punch further having at its basal portion a first tapered annular wall;

the first cylindrical insert having at its end surface an annular lug capable of fitting in the annular groove, so that when the tapered annular wall of the boring punch radially expands an end of the pilot portion, a peripheral wall thereof defining the annular groove is forcibly slanted centrifugally and an outer circular edge of said peripheral wall is stopped by an inner periphery of the annular lug protruding from the cylindrical insert.

2. An apparatus for making self-piercing nuts from blanks therefor which each have a cylindrical pilot portion having blind bores coaxial with and separated by a blind bottom from each other and having an end surface serving as a punch, with the pilot portion as one of peripheral walls formed centrally of a nut body being thereby surrounded by a rim as another peripheral wall extending along a periphery of the nut body and protruding therefrom in the same direction as the pilot portion so as to provide an annular groove between the pilot portion and the rim, the apparatus comprising:

a further punching die which has a second stationary die having a cavity for receiving the blank;

the further punching die having a second cylindrical insert disposed in a bottom region of the cavity;

the second stationary die having in its inner region a second tapered annular wall so that the rim is forcibly slanted centripetally; and a second annular lug formed at an end surface of the second cylindrical insert so that an inner circular edge of said rim is stopped by an outer periphery of the second annular lug when the annular groove is caused to become dovetailed in cross section.

3. An apparatus for making self-piercing nuts, the apparatus comprising the punching die as defined in claim 1 as well as the further punching die as defined in claim 2.

4. An apparatus for making self-piercing nuts from blanks therefor, each blank comprising a cylindrical pilot portion having blind bores coaxial with and separated by a blind bottom from each other and having an end surface serving as a punch, the pilot portion being surrounded by a rim extending along a periphery of the nut body and protruding therefrom in the same direction as the pilot portion, the pilot portion and the rim defining peripheral walls of an annular groove formed therebetween, the apparatus comprising:

a punching die including a boring punch and a first cylindrical insert, the boring punch serving to remove the blind bottom so as to cause the blind bores to communicate with each other, the boring punch further having at its basal portion a first tapered annular wall, and the first cylindrical insert having at its end surface an annular lug capable of fitting in the annular groove of the blank so that, when the tapered annular wall of the boring punch radially expands an end of the pilot portion, the pilot portion serving as a peripheral wall of the annular groove is forcibly slanted centrifugally and an outer circular edge of said peripheral wall is stopped by an inner periphery of the annular lug protruding from the cylindrical insert; and a further punching die including a second stationary die having a cavity for receiving the blank and a second cylindrical insert disposed in a bottom region of the cavity, the second stationary die having in its inner region a second tapered annular wall so that the rim is forcibly slanted centripetally, the further punching die also including a second annular lug formed at an end surface of the second cylindrical insert so that an inner circular edge of said rim is stopped by an outer periphery of the second annular lug when the annular groove is caused to become dovetailed in cross section.

* * * * *